United States Patent [19]

Price

[11] 4,155,519

[45] May 22, 1979

[54] FINDINGS STRUCTURE

[76] Inventor: John E. Price, 8928 Stevens Dr., Des Plaines, Ill. 60016

[21] Appl. No.: 842,578

[22] Filed: Oct. 17, 1977

[51] Int. Cl.[2] ..... B65H 75/02; B69D 69/00

[52] U.S. Cl. ..... 242/118.41; 206/394

[58] Field of Search ..... 242/118.41, 129.71; 206/394, 403, 404, 405, 406, 514

[56] References Cited

U.S. PATENT DOCUMENTS

| | | | |
|---|---|---|---|
| 408,328 | 8/1889 | Steiner | 242/129.71 X |
| 3,434,590 | 3/1969 | Laughlin et al. | 242/118.41 |
| 3,854,673 | 12/1974 | Manning | 242/118.41 |

FOREIGN PATENT DOCUMENTS

| | | | |
|---|---|---|---|
| 27664 | 9/1887 | Canada | 242/118.41 |
| 1253679 | 1/1961 | France | 242/118.41 |

*Primary Examiner*—George F. Mautz

[57] ABSTRACT

A findings structure for maintaining a spool and a bobbin with like filaments thereon in assembled relationship. The spool and bobbin are each provided with axial bores for support of each on a spindle for the use of each, and they are maintained in assembled relationship for storage by means extending into the aligned bores, such means having resilient filamentous material extending therefrom gripping the sides of said aligned bores. The assemblies of the bobbins and spools may be joined by a flexible strand for ready selection and storage as a group of assembled units.

2 Claims, 5 Drawing Figures

FINDINGS STRUCTURE

BACKGROUND OF THE INVENTION

The findings structure herein disclosed is especially useful in the art of machine sewing where like threads are employed in a stitch making bobbin cooperating with a spool. The bobbins are wound from the spool, and the two are readily separated from each other after the sewing operation to the annoyance of the user of the machine. It is the maintenance in assembled and readily disassembled relationship that this invention is especially addressed.

THE DRAWING

Figure 2:
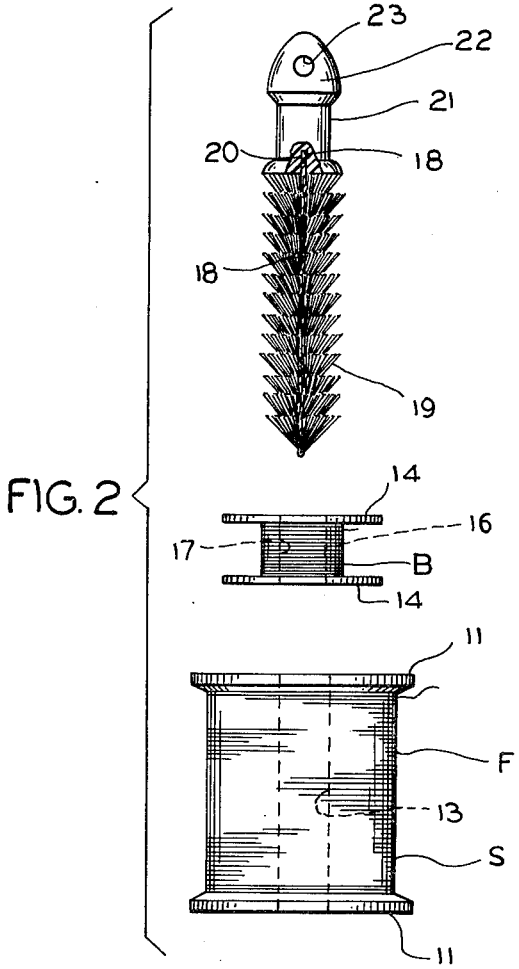
FIG. 2 is an exploded elevational view thereof.
Figure 1:
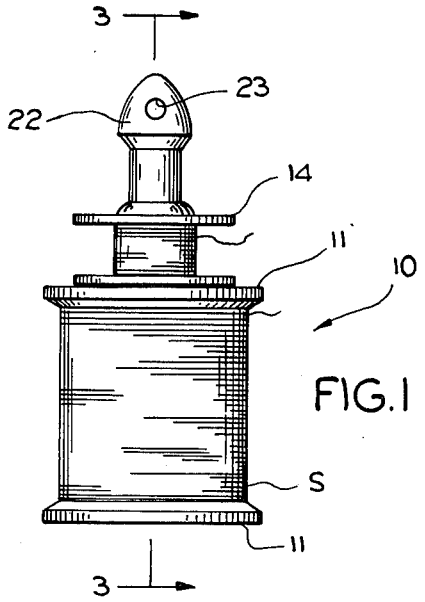
FIG. 1 is an elevational view of a findings structure according to the present invention assembled with bobbin and spool.

The findings structure according to the present invention is denoted generally by the numeral 10 and includes a spool S having end lands 11 and a hub 12 upon which is wound a filament F of a known kind and color. Hub 12 has an axial bore 13.

A bobbin B has end flanges 14 and a hub 16 with an axial bore 17, hub 16 being wound with the filament F like in kind and color to the filament wound on spool S.

Bobbin B and spool S are detachably held together in assembled relationship by means of a probe 18 preferably in the form of a pair of twisted metal strands having wound therewith resilient fibers 19 extending radially of the twisted metal strands. Probe 18 is moulded into a recess 20 at one end of a member 21 adapted to be held by the thumb and forefinger of the user.

Figure 3:
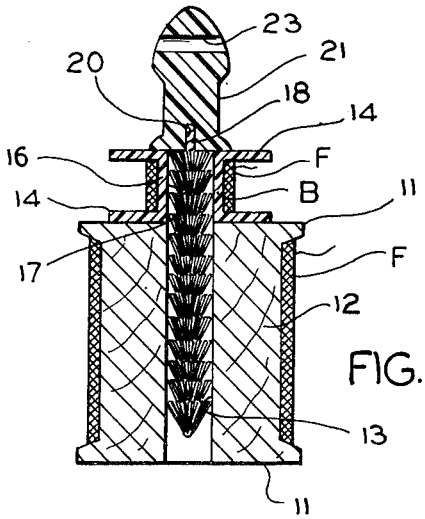
FIG. 3 is a longitudinal sectional through the structure of FIG. 1 taken along the line 3—3 thereof looking in the direction of the arrows.
Figure 5:
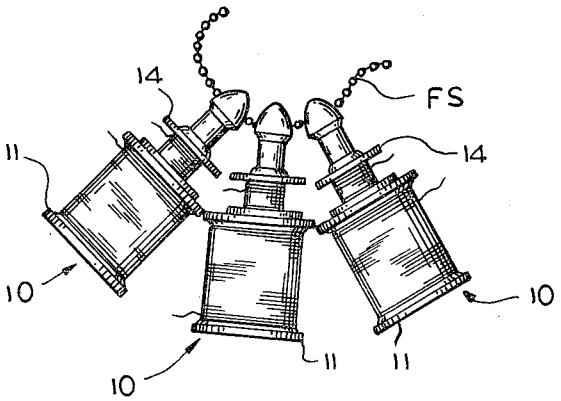
FIG. 5 is a plan view showing the manner in which a plurality of the findings structures may be joined for comparison and storage.
Figure 4:
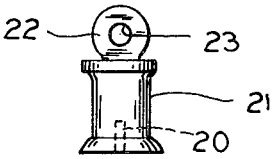
FIG. 4 is an elevation view of finger and thumb gripping structure for the structure of FIG. 1.

Probe 18 with its resilient fibers 19 are adapted to enter the aligned axial bores 13 and 17, the resilient fibers 19 being flexed as seen in FIG. 3, tightly to engage the walls of the bores 13 and 17, and restrain the separation of bobbin B and spool S except as desired.

Member 21 has a generally conical extension 22 therefrom with an aperture 23 therein to receive a flexible strand FS whereby a number of structures 10 may be held together and compared one to another by the user.

I claim:

1. In a findings structure:

(a) a spool having a filament wound thereon;

(b) a bobbin having a quantity of filament wound thereon with a filament corresponding to the type of the filament wound on said spool;

(c) said spool and said bobbin each having an axial bore thereon for support of each on a spindle in the use thereof;

(d) means for detachably joining said spool and said bobbin having like filaments wound thereon for separate use of each and for storage of same;

(e) said means comprising means extending into said bores when axially aligned;

(f) means on said last named means gripping the walls of said bores to maintain said spool and said bobbin together as a unit and releasable from said bores for separate use of said bobbin and said spool;

(g) said means gripping said walls comprising a probe extending longitudinally of said bores and along the axis thereof;

(h) said probe having a plurality of resilient fibrous filaments including free ends extending radially therefrom and receivable in said bores against the walls thereof;

(i) said filaments being distorted by entrance into said bores and offering with said probe resistance to retrograde movement of the probe from said bores to maintain as desired assembly of said spool and said bobbin.

2. The structure of claim 1 wherein said probe is provided with apertures therein whereby a flexible strand may be threaded therethrough to join a plurality of said findings structures for storage and comparison.

* * * * *